US006810840B2

(12) United States Patent
von Gaisberg-Helfenberg

(10) Patent No.: US 6,810,840 B2
(45) Date of Patent: Nov. 2, 2004

(54) INTERNAL COMBUSTION ENGINE AND METHOD FOR THE OPERATION THEREOF

(75) Inventor: Alexander von Gaisberg-Helfenberg, Fellbach (DE)

(73) Assignee: DaimlerChrysler A.G., Stuttgart (DE)

( * ) Notice: Subject to any disclaimer, the term of this patent is extended or adjusted under 35 U.S.C. 154(b) by 0 days.

(21) Appl. No.: 10/435,600

(22) Filed: May 9, 2003

(65) Prior Publication Data

US 2004/0011309 A1 Jan. 22, 2004

(30) Foreign Application Priority Data

May 11, 2002 (DE) ..... 102 21 015

(51) Int. Cl.[7] ..... F01L 9/04

(52) U.S. Cl. ..... 123/90.11; 123/90.15; 123/198 F; 123/90.31; 123/90.22; 123/90.23; 251/129.03

(58) Field of Search ..... 123/90.11, 90.18, 123/90.22–90.24, 90.27, 90.31, 308, 432, 198 F, 90.32; 251/129.03

(56) References Cited

U.S. PATENT DOCUMENTS 5,647,312 A 7/1997 Salber et al. ..... 123/90.16
6,148,779 A * 11/2000 Hickey ..... 123/90.15
6,386,156 B1 * 5/2002 Stockhausen et al. .... 123/90.15
6,431,130 B1 * 8/2002 Leone et al. ..... 123/90.15
6,470,853 B1 * 10/2002 Leone et al. ..... 123/399
6,513,493 B1 * 2/2003 Robichaux et al. ..... 123/399
6,561,145 B1 * 5/2003 Stockhausen et al. .... 123/90.15

FOREIGN PATENT DOCUMENTS

| | | | |
|---|---|---|---|
| DE | 43 41 945 | 2/1995 | |
| DE | 43 41 945 A 1 | 2/1995 | |
| DE | 43 34 995 A 1 | 4/1995 | |
| DE | 695 19 835 T 2 | 3/1996 | |
| DE | 199 18 032 C1 | 11/1999 | |
| DE | 199 32 644 A 1 | 3/2000 | |
| EP | 1 277 923 A1 | 1/2003 | |
| EP | 1359302 A1 * | 11/2003 | ..... F02D/13/02 |
| GB | 2 368 614 A | 5/2002 | |

* cited by examiner

*Primary Examiner*—Thomas Denion
*Assistant Examiner*—Kyle M. Riddle
(74) *Attorney, Agent, or Firm*—Klaus J. Bach

(57) ABSTRACT

In an internal combustion engine including cylinders with inlet and outlet valves, a first inlet valve drive having a first degree of adjustability for operating an inlet valve of at least one cylinder and a second inlet valve drive having a second degree of adjustability for operating an inlet valve of the at least one cylinder, the engine includes other cylinders having inlet valves with inlet valve drives having only the second degree of adjustability for operating the inlet valves of the other cylinders.

8 Claims, 2 Drawing Sheets

INTERNAL COMBUSTION ENGINE AND METHOD FOR THE OPERATION THEREOF

BACKGROUND OF THE INVENTION

The invention relates to an internal combustion engine with at least one adjustable inlet valve.

Internal combustion engines with throttle-free load control are known in the art. In these known designs all inlet valve drives include an electromagnetic actuator and are controlled in a stepless fashion.

DE 43 41 945 A1 further discloses an internal combustion engine with at least two inlet valves, wherein one inlet valve is employed as the main inlet valve and one inlet valve is used as an additional inlet valve. The main inlet valve is operated by a camshaft via a motion transmitting member. The additional inlet valve is operable by a controllable operating mechanism by way of which the valve lift and/or the timing for the opening and the closing of the valve is adjustable. The main valve and the additional valve have different degrees of adjustment.

It is the object of the present invention to provide an internal combustion engine and a method for the operation thereof wherein, inspite of an essentially throttle free load control, the design expenses and the required space are relatively small.

SUMMARY OF THE INVENTION

In an internal combustion engine including cylinders with inlet and outlet valves, a first inlet valve drive having a first degree of adjustability for operating an inlet, valve of at least one cylinder and a second inlet valve drive having a second degree of adjustability for operating an inlet valve of the at least one cylinder, the engine includes other cylinders having inlet valves with inlet valve drives having only the second degree of adjustability for operating the inlet valves of the other cylinders.

With the arrangement according to the invention, an essentially throttle-free load control can be achieved and the design expenditures, the construction space requirements, the weight, the energy requirements and the costs can be relatively low. In percentage values, the degree of adjustment may vary between zero percent, that is, non-adjustable, and 100%, that is, steplessly adjustable; for example, with a particular valve drive the valve opening and closing timing may be steplessly adjustable; with another inlet valve drive, particular predetermined valve opening and closing times with given timing steps may be provided and with another valve drive the opening and closing times may not at all be adjustable.

If the inlet valve drive with the first degree of adjustability and the inlet valve drive with the second degree of adjustability are provided for one particular cylinder, a high degree of flexibility and an advantageous uniform loading of the internal combustion engine can be achieved.

If the inlet valve drive with the second degree of adjustability can be disabled energy can be saved by the disabling and, on the other hand, particularly in the lower partial load operating ranges, an advantageous throttle-free load control can be achieved.

The inlet valve drives can be formed by various mechanisms, which appear reasonable to an expert in the field. The inlet valve drives may include for example controllable camshafts. It is however advantageous if at least one inlet valve drive, particularly the inlet valve drive having the higher degree of adjustability includes an electromagnetic actuator. With electromagnetic actuators a high degree of adjustability can be achieved in a simple manner.

If at least one inlet valve drive, particularly an inlet valve drive with a low degree of adjustability, is at least partially part of an outlet valve drive, for example, in that one or several inlet valves are operated by a camshaft which, at the same time, operates outlet valves, a number of components, space, weight and expenses can be saved.

In other embodiments of the invention at least one cylinder may be provided with a throttle valve and for at least one cylinder the ignition timing may be adjustable, particularly in cylinders with inlet valve drives which have a low degree of valve adjustability. In certain transition areas, the enabling and disabling of inlet valve drives and/or cylinder groups may advantageously be controlled so as to prevent undesired gas flows. Furthermore, rapid load changes can be realized in a simple manner if at least for certain cylinders the ignition timing is adjustable.

Various combinations of the inlet valve drives with different degrees of adjustability may be provided. A solution which, based on design, expenditure and construction volume, is particularly advantageous is achieved with an internal combustion engine which includes a primary cylinder group whose cylinders have each at least a steplessly adjustable inlet valve drive with the first degree of adjustability and at least one inlet valve drive, which can be disabled, and which has a second degree of adjustability which is lower than the first degree of adjustability, and the internal combustion engine includes a secondary group of cylinders, which can be switched inoperative.

With such an internal combustion engine, advantageously in a first load range, only the inlet valves with the first degree of adjustment of the primary cylinder group are activated and, in a second higher load range, the inlet valve drives with the second degree of adjustment of the primary cylinder group can be additionally activated. In a third still higher load range, the secondary cylinder group can be activated. Within the load ranges, the load can be controlled to a large-extent by the inlet valve drives of the first degree of adjustment of the primary cylinder group.

The invention and its advantages will become more readily apparent from the following description of a preferred embodiment thereof on the basis of the accompanying drawings:

DESCRIPTION OF A PARTICULAR EMBODIMENT

Figure 1:
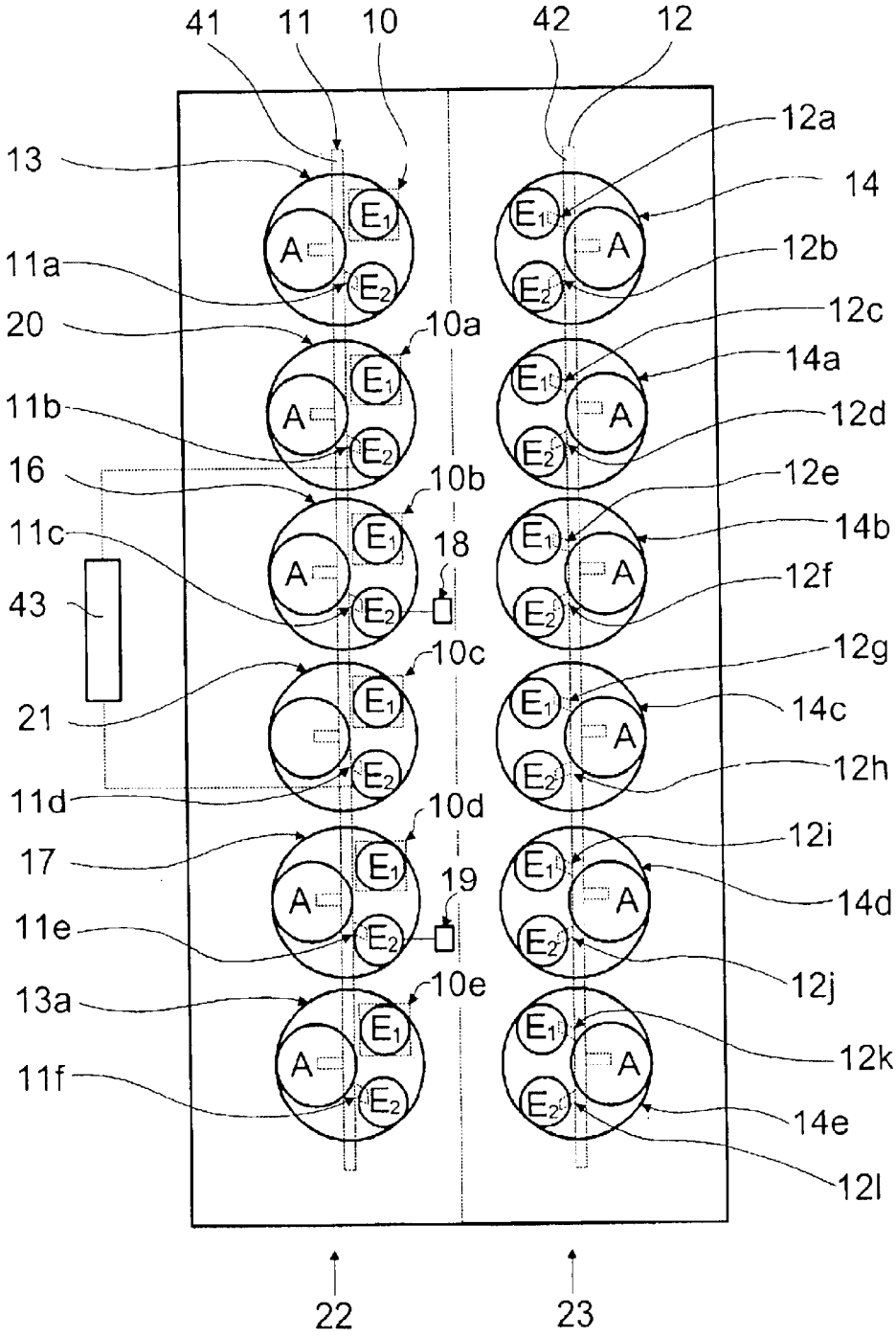
FIG. 1 is a schematic top view of an internal combustion engine according to the invention.

FIG. 1 shows schematically an internal combustion engine with twelve cylinders 13, 13*a*, 14, 14*a*, 14*b*, 14*c*, 14*d*, 14*e*, 16, 17, 20, 21, wherein each cylinder includes two inlet valves E1, E2 and one outlet valve A.

The cylinders 13, 13*a*, 14, 14*a*, 14*b*, 14*c*, 14*d*, 14*e*, 16, 17, 20, 21 are divided into a primary cylinder group 22 and a secondary cylinder group 23.

The cylinders 13, 13*a*, 16, 17, 20, 21 of the primary cylinder group 22 include each a steplessly adjustable inlet valve drive 10, 10*a*, 10*b*, 10*c*, 10*d*, 10*e* having a first degree of an adjustability and an inlet valve drive 11*a*, 11*b*, 11*c*, 11*d*, 11*e*, 11*f*, which has a second lower degree of adjustability and which can be disabled. Expressed on a percentage basis the degree of adjustability of the first valve drive is 100% and the degree of adjustability of the second valve drive is 0%, that is, for the first inlet valve drive 10, the inlet valve opening and closing times can be adjusted steplessly whereas for the second inlet valve drive 11, the opening and closing times are fixed. The cylinders 14, 14*a*, 14*b*, 14*c*, 14*d*, 14*e* of the secondary cylinder group 23 have inlet valve drives 12*a*, 12*b*, 12*c*, 12*d*, 12*e*, 12*f*, 12*g*, 12*h*, 12*i*, 12*j*, 12*k*, 12*l*, with the second degree of adjustability.

Figure 2:
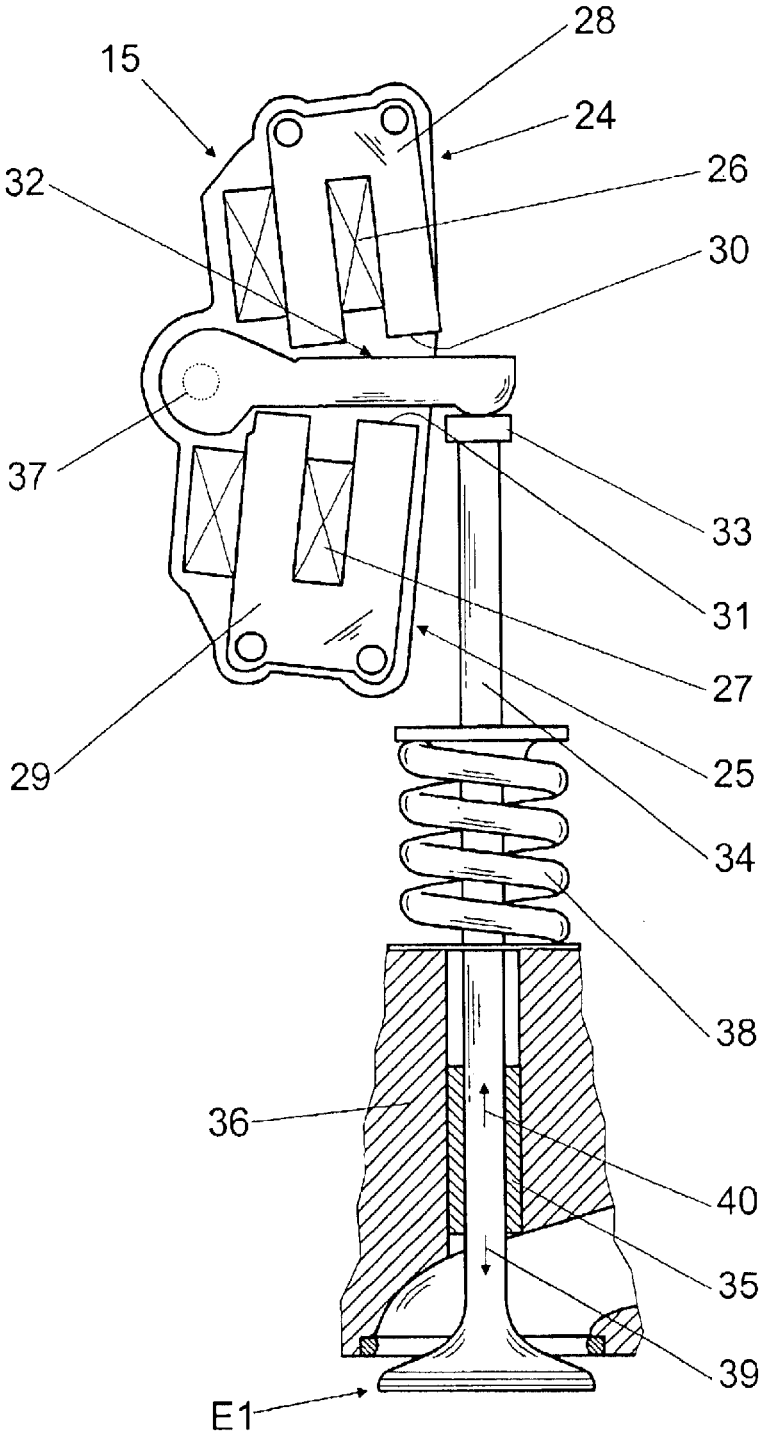
FIG. 2 shows a steplessly adjustable inlet valve drive.

The inlet valve drives 10 (including 10*a*–*e*) have electromagnetic actuators 15 (FIG. 2). An electromagnetic actuator 15 as shown in FIG. 2 includes an electromagnetic operating unit with two electromagnets 24, 25, that is a valve opening magnet 25 and a valve closing magnet 24. Each of the electromagnets 24, 25 includes a magnetic coil 26, 27 wound onto a coil carrier and a coil core 28, 29 with two legs which have pole surface area 30, 31. Between the pole surface areas 30, 31 a pivot axis (at 37) between the pole surfaces 30, 31. The pivot armature 32 engages a valve shaft 34 of a gas exchange valve E1 by way of a play compensation element 33. The valve shaft 34 is axially slidably supported in the cylinder head 36 by way of a valve shaft guide 35.

Furthermore, the actuator 15 includes a spring mechanism with two pre-stressed valve springs 37, 38, that is, a torsional spring 37 acting in the valve opening direction 39 and a compression coil spring 38 acting in valve closing direction 40.

The inlet valve drives 11, 12 are partially operated by the same valve drive as the outlet valves: The inlet valves E2 of the primary cylinder group 22, and the inlet valves E1 and E2 of the secondary cylinder group 23 are operated by camshafts 41, 42 by which also the outlet valves A are operated.

During operation of the internal combustion engine, it is advantageous to activate in a first load range only the inlet valve drives 10 (10–10*e*) with the first degree of adjustability of the primary cylinder group 22. The inlet valve drives 11 (11*a*–11*f*) of the primary cylinder group 22 and those of the secondary cylinder group 23 are disabled (switched off). The load control is performed by the stepless adjustment of the inlet valve drives 10 to 10*e* of the primary cylinder group 22 until they are set for complete filling of the cylinders.

Upon a further load increase, the inlet valve drives 11 (11*a*–11*f*) of the primary cylinder group 22 are activated and the inlet valve drives 10 are adjusted for a lower cylinder filling. The secondary cylinder group 23 remains switched off. With increasing load, the cylinder filling is increased by control of the inlet valve drives 10 until the maximum filling value that can be reached is obtained.

Upon a still further increase of the load requirements, the inlet valve drives 12*a*, 12*c*, 12*e*, 12*g*, 12*i*, 12*k* for the inlet valves E1 of the secondary cylinder group 23 are activated. The inlet valve drives 10 (10–10*e*) of the primary cylinder group 22 are again set back to a low filling degree. With increasing load, the cylinder filling of the primary cylinder group 22 is adjusted by the inlet valve drives 10 (10–10*c*) until the maximum filling degree is reached.

With still further increasing load requirements, then the inlet valve drives 12*b*, 12*d*, 12 *f*, 12*h*, 12*j*, 12*l* for the inlet valves E2 of the secondary cylinder group 23 are activated so that also the inlet valves E2 of the secondary cylinder group 23 are operated. The load control is performed also in this stage by the inlet valve drives 10 (10–10*e*) of the primary cylinder group 22.

In order to be able to suitably control the engine in the transition ranges, particularly with the enabling and disabling of individual inlet valve drives and/or cylinder groups and to avoid undesirable disturbances and also to be able to provide for rapid load changes, the cylinders 16 and 17 of the primary cylinder groups 22 each include a throttle valve 18 and, respectively, 19 and the ignition timing of the cylinders 20 and 21 can be changed by a control unit 43. However, under normal operation, the engine operates unthrottled by throttle valves.

What is claimed is:

1. An internal combustion engine including at least one cylinder with inlet and outlet valves, an outlet valve drive, a first inlet valve drive having a first degree of adjustability for driving one of the inlet valves of said at least one cylinder, a second inlet valve drive having a second degree of adjustability which is smaller than said first degree of adjustability for driving another inlet valve of said at least one cylinder, said engine including at least one other cylinder having an outlet valve with an outlet valve drive, at least one inlet valve with an inlet valve drive having said second degree of adjustability, one of said inlet valve drives being combined with the outlet valve drive of one of said at least one and said at least one other cylinder.

2. An internal combustion engine according to claim 1, wherein for said at least one cylinder which includes an inlet valve including an inlet valve drive with said first degree of adjustability and another inlet valve with an inlet valve drive having said second degree of adjustability, said outlet valve drive is combined with said inlet valve drive of smaller adjustability.

3. An internal combustion engine according to claim 1, wherein at least one of said inlet valve drives with said first degree of adjustability comprises an electromagnetic actuator.

4. An internal combustion engine according to claim 1, wherein at least one cylinder is provided with a throttle valve for additionally controlling the filling degree of said at least one cylinder.

5. An internal combustion engine according to claim 1, wherein at least one cylinder includes means for variably controlling the ignition timing therein.

6. An internal combustion engine according to claim 1, wherein said internal combustion engine includes a primary group of cylinders having each at least a first inlet valve with a steplessly adjustable inlet valve drive of said first degree of adjustability and at least one inlet valve with a second inlet valve drive with said second degree of adjustability, which is lower than the first degree of adjustability and which can be disabled, and a secondary group of cylinders which can be selectively disabled.

7. A method of operating an internal combustion engine including a primary group of cylinders having first inlet valves with first inlet valve drives of a first degree of adjustability and second inlet valves with second inlet valve drives that can be selectively disabled so that the second inlet valves remain selectively closed, said second inlet valve drives having a second degree of adjustability which is smaller than that of said first inlet valve drives, and a secondary group of cylinders which can be selectively disabled, said internal combustion engine having a first load range in which exclusively the first inlet valve drives with the first degree of adjustability of said primary group of cylinders are operated, a second higher load range in which additionally the inlet valve drives with the second degree of adjustability for driving the second inlet valves of said primary cylinder group are activated, and a third still higher load range in which also the secondary cylinder group is activated, said method comprising the steps of controlling the engine load within each load range essentially by way of the inlet valve drive with the first degree of adjustability of said primary cylinder group.

8. A method according to claim 7, wherein said inlet valve drive with said second degree of adjustability is disabled during operation of said engine in said first load range.

* * * * *